United States Patent [19]

Brown

[11] Patent Number: 4,815,438

[45] Date of Patent: Mar. 28, 1989

[54] ACCELERATOR FOR PAIRED MASSES

[76] Inventor: David W. R. Brown, 20016 Graves Run Rd., Hampstead, Md. 21074

[21] Appl. No.: 827,962

[22] PCT Filed: Jan. 27, 1986

[86] PCT No.: PCT/US86/00135

§ 371 Date: Jan. 27, 1986

§ 102(e) Date: Jan. 27, 1986

[87] PCT Pub. No.: WO87/04511

PCT Pub. Date: Jul. 30, 1987

[51] Int. Cl.[4] ..... F41B 3/04

[52] U.S. Cl. ..... 124/6; 124/8; 124/34; 124/63; 272/36; 244/63

[58] Field of Search ..... 124/1, 6, 32, 34, 63, 124/8, 9; 244/63, 137.1; 272/36, 38

[56] References Cited

U.S. PATENT DOCUMENTS

| | | | |
|---|---|---|---|
| 722,132 | 3/1903 | McQueen | 124/34 X |
| 924,155 | 6/1909 | Fitch | 272/36 |
| 1,327,518 | 1/1920 | Barnes | 124/6 |
| 1,599,075 | 9/1926 | Burris | 272/36 |
| 1,704,968 | 3/1929 | Gale | 244/63 |
| 2,077,672 | 4/1937 | Buxton et al. | 124/34 |
| 2,328,852 | 9/1943 | Shepherd | 272/36 |
| 2,409,763 | 10/1946 | Janiewski | 244/63 |
| 2,559,768 | 7/1951 | Howard | 272/36 |
| 3,585,978 | 6/1971 | Hurlimann | 124/6 |
| 3,724,438 | 4/1973 | Brandt | 124/32 X |
| 3,989,206 | 11/1976 | Gregory | 124/6 X |

*Primary Examiner*—Richard J. Apley
*Assistant Examiner*—David J. Bender
*Attorney, Agent, or Firm*—Eugene F. Osborne, Sr.

[57] ABSTRACT

A method and apparatus has two stages of acceleration establishing levels of kinetic energy in paired bodies contributing to a total system mass that is to be accelerated in a given time profile. A first stage of acceleration places the paired bodies in helical trajectories about a toroidal space. The second stage of acceleration has mutual cross coupling between the paired masses for the reflection of reaction forces resulting from the independently, but simultaneously, applied forces for enhancement of the acceleration and for mutual suppression of recoil within the apparatus.

9 Claims, 4 Drawing Sheets

ACCELERATOR FOR PAIRED MASSES

BACKGROUND OF THE INVENTION

1. Field of the Invention

This invention relates to machine elements and mechanisms, to mass accelerators and to recoilless launching apparatus for paired bodies, each possessing mass.

2. Description of Related Art

The acceleration of a body is proportional to an applied resultant force and is in the direction of this force. In the acceleration of a body the effective or resultant force is always opposed by an equal reaction force within the same line of action. In many prior art applications, well known in the mechanics branch of physics, the acceleration of a mass involves systems or mechanisms wherein nonconservative or dissipative forces are used to accelerate the body. The mechanical energy in nonconservative or dissipative force systems is not completely recoverable or useable in accomplishing work.

SUMMARY OF THE INVENTION

In this invention the effective total mass is established in pairs of bodies or masses of similar design. Acceleration of the pairs of masses is achieved in two stages or phases. A first acceleration of the mass pairs is achieved through mechanisms that dissipate reaction forces of the applied mechanical energy. A second acceleration of the mass pairs is achieved simultaneously through recoil suppression mechanisms that conserve reaction forces, hence, a greater portion of the applied mechanical energy is effectively used. Expressed alternatively, the second acceleration of the equivalent total mass is accomplished with a reduction in the expenditure of the supplied mechanical energy that is necessary to achieve a stated velocity of the respective masses.

In a preferred embodiment of the invention the mass pairs are guided by the assembled structure so as to follow, in the first step of acceleration, phased helical trajectories encompassing a toroidal space. In the second step of acceleration the two bodies, of each mass pair, are subjected, simultaneously to directly applied thrusts that are coordinated, in time, and also to the respective reaction forces of the thrust that is applied to the other companion body of the pair of masses. The respective reaction forces are cross coupled in opposing directions within the elements of the interconnecting structure that is provided to effect a mechanical linkage between the respective mass holders so as to enhance the directly applied action thrusting forces. Thus the reaction force "R(A)" to the thrust "F(A)" applied to mass "M(A)" is reflected through the linking structure to appear at mass "M(B)" simultaneously, in the same direction, so as to reinforce or add to the thrust "F(B)" locally applied at mass "M(B)". Simultaneously, the reaction force "R(B)" to the thrust "F(B)" that is applied to mass "M(B)" is reflected through the linking structure to appear at mass "M(A)" in the direction for adding to the thrust "F(A)", locally applied at mass "M(A)". The simultaneous reflection of the respective reaction forces provides counterbalancing in the structural elements of the accelerator since they are substantially equal in magnitude and opposite in their resultant direction within the respective elements. Recoil to the second step of acceleration is therefore suppressed, being dependent upon the symmetry and simultaneity of the directly applied accelerating forces.

Although the masses are in motion relative to an observer, following the first stage of acceleration, they are in a fixed relationship relative to each other, because the supporting structural linkage of the apparatus stays intact and invariant throughout the motion. When the second stage of acceleration occurs, the energy required is that amount needed to increase the velocity of each mass, with reduced recoil in an imperfect energy conserving system, and thereby add to the initial velocity of the first sage of acceleration so as to achieve the desired "final" velocity. The respective masses, thus accelerated by the two stage method, each have kinetic energy at the expense of less applied energy. Thus an improvement in efficiency is achieved. The paired masses, having been put in motion, can be harnessed by methods well known that are not a part of this disclosure to accomplish useful work such as to generate electricity, travel as projectiles, power vehicles, and generate thrust.

Therefore, it is a principal object of this invention to provide a method and apparatus for improvement in the efficiency of the acceleration of mass to desired velocities and levels of kinetic energy.

Another object of this invention is to divide the total mass into at least one pair of discrete bodies, each of which is accelerated to the desired velocity.

Another object of this invention is to provide a method and apparatus for accelerating pairs of masses simultaneously.

A further object of this invention is to provide a method and apparatus for accelerating pairs of masses simultaneously with the enhancement of the acceleration by mutual cross coupling and reflection of reaction forces and with suppressed recoil of accelerating mechanical elements of the cross coupled mechanical train.

Still another object of this invention is to provide a method and apparatus for the acceleration of at least one pair of masses in two stages for the addition of the initial and secondary velocities.

Other objects, features, and advantages will become apparent from the description in connection with the accompanying drawings of the presently preferred embodiments of the invention.

BRIEF DESCRIPTION OF THE DRAWINGS

The invention is described with reference to accompanying drawings, in which.

DESCRIPTION OF THE PREFERRED EMBODIMENTS

The kinetic energy of a mass that is in motion varies as the square of its velocity. If the velocity of the mass is doubled its kinetic energy is increased fourfold, etc. The method and means by which a mass attains a given velocity impacts upon the energy efficiency of the system. The applied energy may be conserved, hence the system efficiency may be improved, if the total mass is distributable in an even number of smaller bodies of mass and if conserving methods and apparatus are used in their acceleration to the desired velocity. Expressed in another way, if an even number of bodies, each having mass, are to be put in motion to attain a given velocity in the same time profile, the supply energy required for acceleration of all of the bodies can be conserved if the reaction forces accompanying the acceleration of each mass can be channeled so as to aid the acceleration of the companion mass of each pair of bodies or objects that are put in motion. Reaction energies that are typically dissipated may, in accordance with this invention, be used to perform useful work in the mass acceleration process and thus improve total system efficiency.

Figure 1:
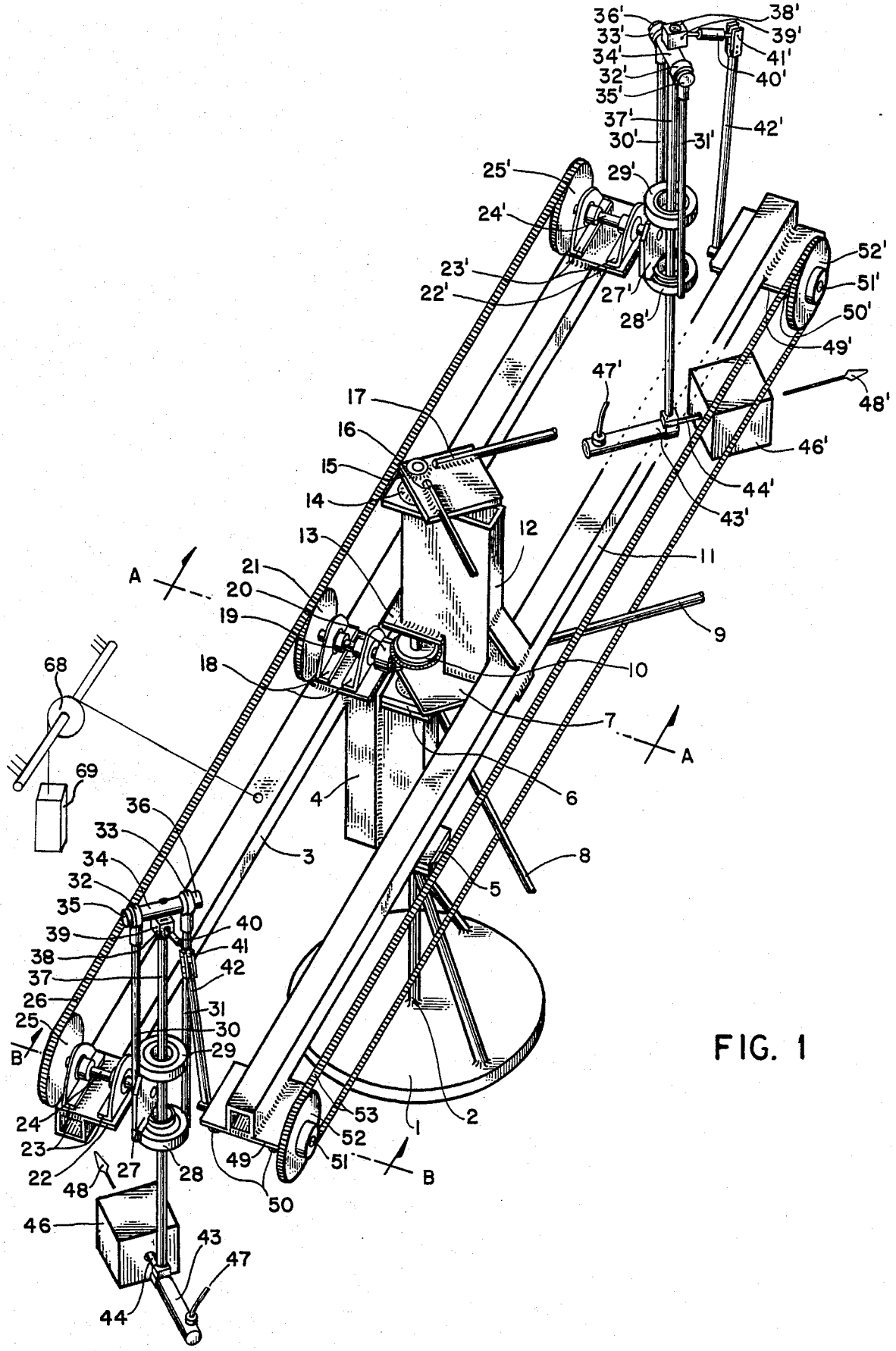
FIG. 1 is a perspective of a preferred embodiment of the invention.
Figure 2:
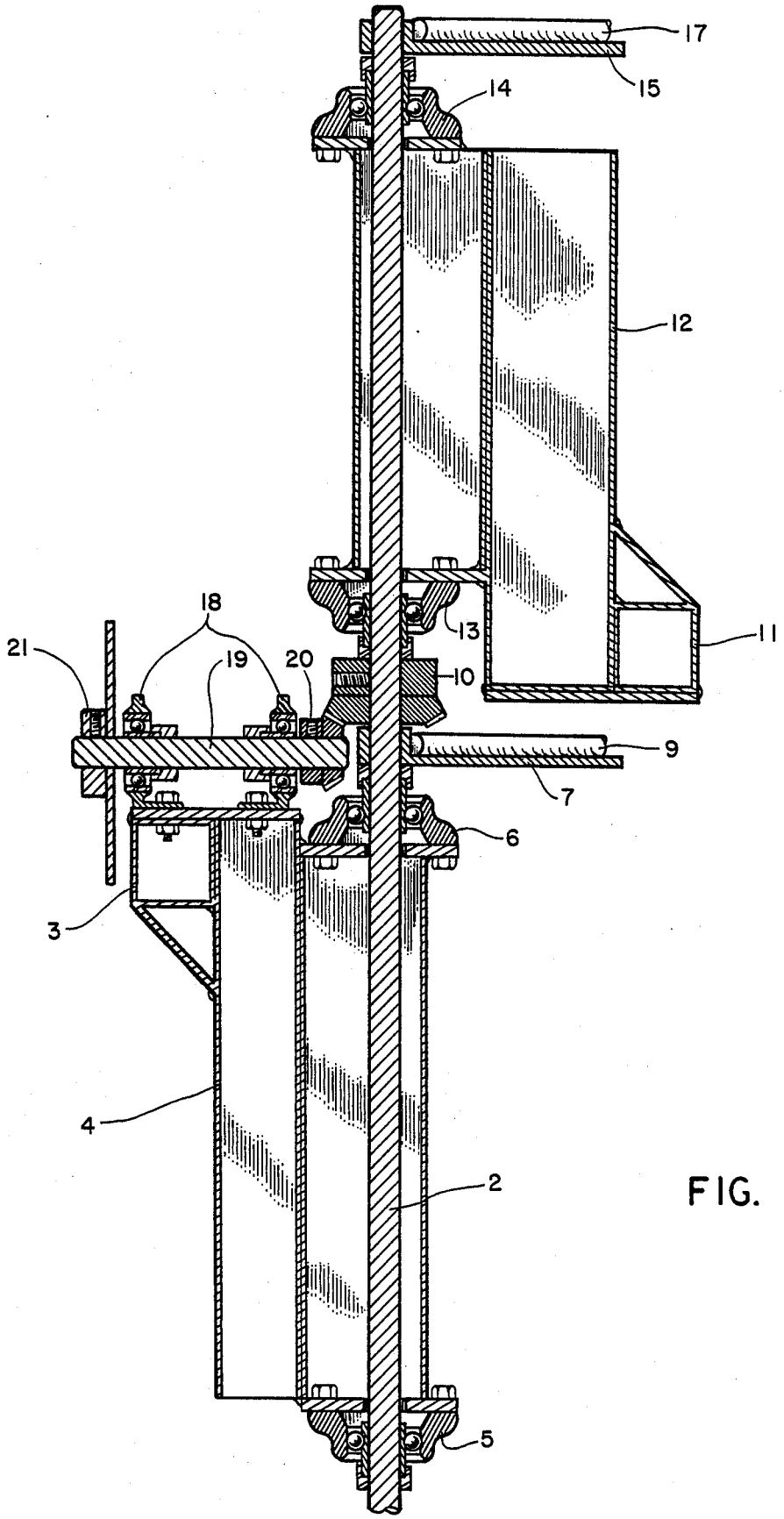
FIG. 2 is a transverse cross-section elevation view of the invention at the central shaft, at lines A—A of FIG. 1.

Referring now to FIGS. 1 and 2, a supporting structure 1 holds a central shaft 2 solidly in a vertical position. An energy transmission arm 3 is attached thru supporting structure 4 and bearings 5 and 6. Energy arm 3 is able to freely rotate about shaft 2. A mid-shaft stabilizing assembly 7 consists of a shaft collar welded to a plate to which are attached two stabilizing arms 8 and 9 which are at right angles to each other and whose other ends (not shown) are attached to the walls of the room or a stable body. A bevel gear 10 is located above the stabilizing assembly 7 and is firmly attached to shaft 2 by a setscrew and a shaft key.

Above bevel gear 10 is a reaction transmission arm 11 which is attached thru supporting structure 12 and bearings 13 and 14. The reaction arm is able to freely rotate about shaft 2. Above bearing 14 is a top-shaft stabilizing assembly 15 which consists of a shaft collar welded to a plate to which are attached two stabilizing arms 16 and 17 which are at right angles to each other and whose other ends (not shown) are attached to the walls of the room or a stable body. When the second phase energy is applied the forces tend to bend the central shaft 2, however it is held straight and vertical by bolting the supporting structure 1 to the floor and by incorporating the mid- and top-shaft stabilizing assemblies 7 and 15.

Attached to the top surface of supporting structure 4 are a pair of pillow blocks 18 which support drive shaft 19 which has a keyway. At the front end of shaft 19 nearest the vertical central shaft 2 is a bevel gear 20 which is firmly attached to shaft 19 by a key and a setscrew and mates with bevel gear 10. At the back end of shaft 19 is a drive sprocket 21 which is attached to shaft 19 by a shaft key and setscrew.

Each end of energy arm 3 and reaction arm 11 have similar structures attached to them. To avoid repetition, only one of these is described in detail. The corresponding elements of the second structure have been assigned the same reference numbers to which have been added prime marks to differentiate them.

Figure 3:
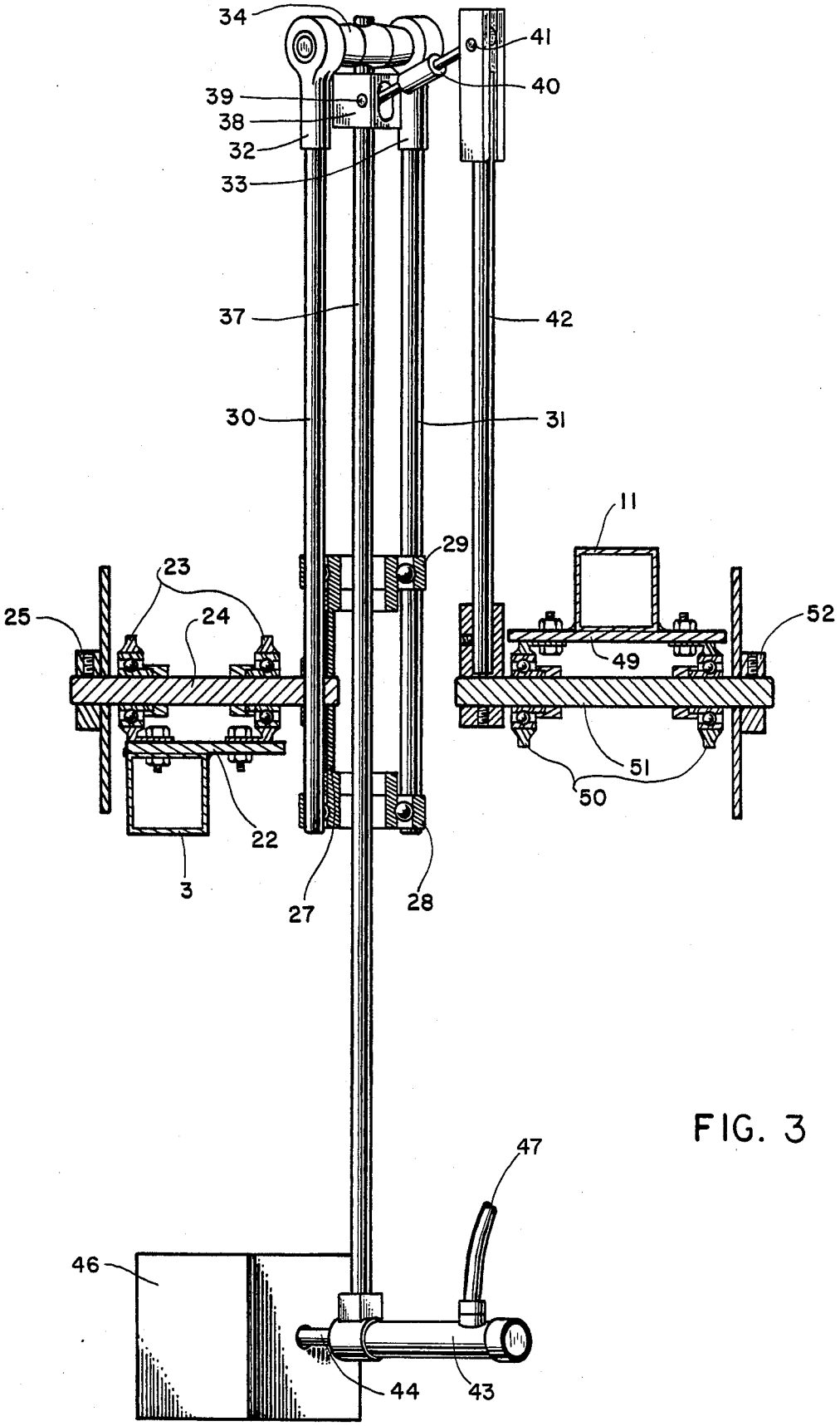
FIG. 3 is a transverse cross-section elevation view of the typical paired mass supporting subassembly, at lines B—B of FIG. 1.

Referring now to FIGS. 1, 2 and 3, at one end on top of energy arm 3 is welded a supporting plate 22. On its top surface is mounted a pair of pillow blocks 23 which support driven shaft 24 which has a keyway. The center line of shaft 24 is 101.063 cm (39.789 in.) from the centerline of shaft 19. A driven sprocket 25 is attached to the back end of shaft 24 by a shaft key and setscrew.

An endless roller chain 26 passes over and around sprockets 25, 21, and 25'. As energy arm 3 rotates about central shaft 2, bevel gear 20 rotates and thru shaft 19 causes drive sprocket 21 to rotate which in turn causes driven sprocket 25 and 25' to rotate in unison.

A plate 27 is attached to the front end of driven shaft 24 with a shaft key and setscrew. The inner ring of an extended inner-ring ball bearing 28 is welded to the bottom of plate 27 perpendicular to its face. Another extended inner-ring ball bearing 29 is similarly welded to the top of plate 27. Two support shafts 30 and 31 are welded vertically 180 degrees apart to the outer rings of ball bearings 28 and 29. As shown in FIG. 1, shaft 30 is behind plate 27 while shaft 31 is in front. The upper ends of the support shafts are threaded to accept rod-end bearings 32 and 33 between which is mounted swing shaft 34. Because the lower ends of the two support shafts are attached to the outer rings of the ball bearings, swing shaft 34 can be adjusted to a 45 degree or greater angle relative to the plane of the face of plate 27. A clamp 59 (not shown) clamps the inner and outer rings of the bearing to keep shaft 34 at a selected angle. The centerline of swing shaft 34 is 40.43 cm (15.915 in.) from the centerline of driven shaft 24. The centers of swing shafts 34 and 34' are in a plane which is parallel to energy arm 3 and which passes through the axis of the central shaft 2.

Swing shaft 34 is secured by shaft collars 35 and 36 at each end. Throw arm 37 passes thru shaft 34 midway between the rod-end bearings 32 and 33. Attached to throw arm 37 just below shaft 34 is pivot block 38. In the structure at the other end of energy arm 3, the pivot block 38' which is attached to throw arm 37' is just above shaft 34'. In the pivot block is located a dowel pin 39 whose centerline is 1.16 cm. (0.455 in.) from the centerline of throw arm 37 and 2.01 cm (0.790 in.) from the centerline of shaft 34. The dowel pin acts as a pivot point for coupling rod 40 which has a hole drilled in it through which the dowel pin passes. The other end of the coupling rod ends in a pivot joint 41 which is in turn connected to reaction strut 42 which will be described below. The distance from the centerline of dowel pin 39 to the center of pivot joint 41 is 17.50 cm (6.889 in.).

Throw arm 37 has attached to its other end an air-operated pneumatic cylinder 43 with an internal diameter of 2.54 cm (1 in.) and an operating rod 44 with a stroke length of 15.24 cm (6 in.). The centerline of operating rod 44 is 80.851 cm (31.831 in.) from the center line of swing shaft 34. Surrounding the operating rod and attached to the end of the cylinder is the face of a magnetic clutch 45 (not shown). A mass ( or weight) 46 of 4.5359 kg (10 lbs.) with a hole drilled partially thru rests over the end of the operating rod 44 of the cylinder 43 and comes in contact with the magnetic clutch face. When the clutch face is energized, the weight is held securely in place. When air pressure is applied to cylinder 43 thru air hose 47 from an air compressor, the current to the clutch face is cutoff, the cylinder's operating rod 44 extends and throws mass 46 on trajectory path 48.

Welded to the bottom of one end of reaction arm 11 is reinforcing plate 49 on whose bottom surface is mounted a pair of pillow blocks 50 which hold reaction shaft 51, which has a keyway. The centerline of reaction shaft 51 is directly in line with the centerline of driven shaft 24 located directly across on the energy arm 3. Reaction strut 42 is securely attached to the inward end of the shaft 51. The other end of reaction strut 42 attaches to pivot joint 41 which has been described previously. The outer end of the shaft 51 has a reaction sprocket 52 attached to it which is keyed to the keyway in the shaft. Passing over and around reaction sprockets 52 and 52' is reaction chain 53 which causes the two reaction sprockets to rotate in unison.

Figure 4:
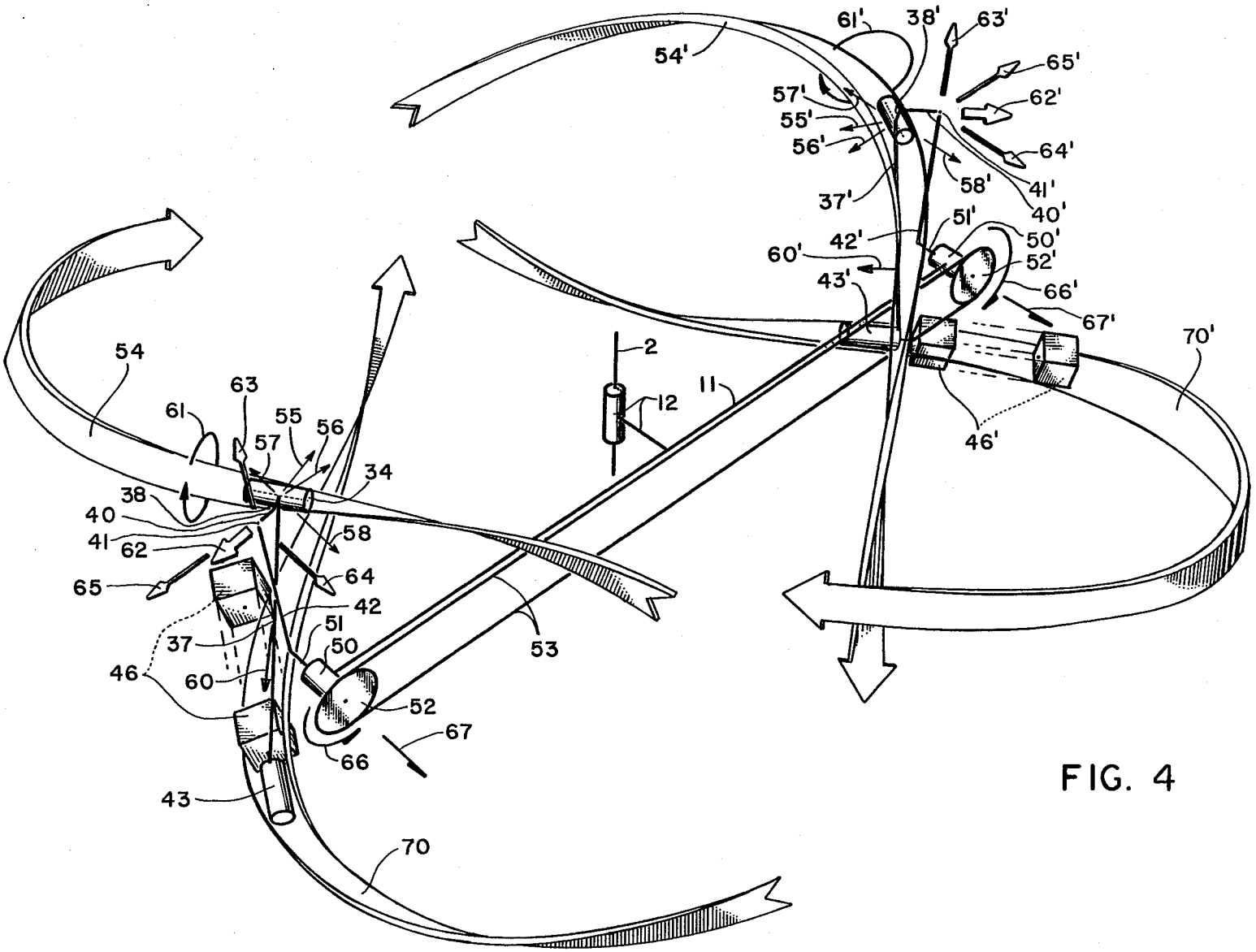
FIG. 4 is graphic illustration of the force vectors and trajectories of a pair of mass bodies during acceleration in the second phase.

FIG. 4 shows a symbolic drawing of the motions and forces involved in the operation of my invention. Helical path 54 is that followed by swing shaft 34 as a result of the rotation of energy arm 3 about central shaft 2. This helical path is developed as a result of the interaction of fixed bevel gear 10 which mates with bevel gear 20 causing it to rotate and drive the chain 26. The motion of chain 26 and driven sprocket 25 causes plate 27 to rotate and propel swing shaft 34 in a circle about it. This circular motion combines with the forward motion of energy arm 3 to produce helical path 54.

In an alternative embodiment, machined ways or rods bent into the helical shape of path 54 may achieve the same mechanical result. When one presses laterally on swing shaft 34, there will be no 'give.' This is of course apparent in the case of machined ways or bent rods. In the illustrated embodiment of FIG. 1, the same effect occurs because a lateral push in direction 55 (FIG. 4) is equivalent to orthogonal component force vectors 56 and 57. Vector 56 applied, in FIG. 1, through energy arm 3 back to bevel gear 20 would tend to cause energy arm 3 to want to move in direction 58. However vector 57 counteracts this tendency so that swing shaft 34 becomes a stable element as far as lateral forces on it are concerned.

The angle of helical path 54 relative to the face of plate 27 varies as swing shaft 34 rotates about driven shaft 24. This is because shaft 34 travels a greater distance forward when it is further away from central shaft 2. For example, in this embodiment, helical path 54 forms a 45-degree angle with plate 27 when it is nearest central shaft. 2. When it is farthest away, it forms approximately a 23-degree angle with the plate. Therefore, bearing clamp 59 (not shown) is provided to clamp the inner- and outer-rings of ball bearing 28 so that shaft 34 is held at the appropriate angle to parallel helical path 54 at the instant of activation of the pneumatic cylinder 43.

When pneumatic cylinder 43 is activated to accelerate mass 46 forward, a backward force vector 60 is generated in throw arm 37. Because the inside diameters of the inner rings of bearings 28 and 29 are larger than the diameter of the throw arm 37 so as to establish a clearance area surrounding arm 37, the backward force vector 60 causes swing shaft 34 to want to rotate about helical path 54 in direction 61. Note that since the rotational force is lateral to helical path 54, shaft 34 is neutral in terms of moving forward or backward along path 54. Pivot block 38 transmits rotational torque to coupling rod 40. Thus the acceleration of mass 46 has caused a reaction in coupling rod 40 in the form of force vector 62. At the point where coupling rod 40 engages reaction strut 42, the force vector 62 can be represented by three component vectors in an orthogonal coordinate system, namely 63, 64 and 65. Vector 63 is up thru the centerline of reaction strut 42. Vector 64 is backward and causes reaction arm 11 to want to move backward in direction 67. Vector 65 causes strut 42 and ultimately reaction chain 53 to want to move in direction 66. Simultaneously, vector 63' is up thru the centerline of strut 42'. Vector 64' is forward and causes reaction arm 11 to want to move forward in direction 67'. Vector 65' causes strut 42' and ultimately reaction chain 53 to want to move in direction 66'.

It now becomes apparent that by choosing the appropriate angular relationships of reaction struts 42 and and 42' and the appropriate acceleration forces for masses 46 and 46' and appropriate lengths of the various connecting elements, that rotation force 67 can be made to equalize rotational force 67' and the torque 66 on reaction sprocket 52 can be made to equalize the torque 66' on companion sprocket 52'.

There are several angular relationships of reaction struts 42 and 42' where the counteracting forces are exactly equalized. In addition, there is an area on each side of these optimum angular relationships in which the opposing forces approach equalizing each other. If the pneumatic cylinder is caused to operate just before or just after the optimum angular relationship, there is a tendency for swing shaft 34 to slow down or speed up. However, by adjusting the angle of cylinder 43 slightly away from being perpendicular to shaft 34, the shaft will want to go forward both before and after the perfect angular relationship. This does cause a slight loss of efficiency (less than 1% in this embodiment) but does allow the cylinder 43 to be activated just prior to the most efficient angle with maximum acceleration occurring as the arms pass thru the optimum angular relationship.

This ability for the masses 46 and 46' to be accelerated, effectively 'away from each other', but both in a forward direction while already in motion is a principal feature of the invention. The masses 46 and 46' are given an initial acceleration. In the case of this illustrated embodiment, energy arm 3 has attached to it a wire which passes over over pulley 68 to weight 69. Weight 69 is dropped to provide an initial acceleration (that is repeatable) to energy arm 3 and thus to masses 46 and 46'.

After the initial stage of acceleration, as swing shaft 34 moves along helical path 54 and mass 46 moves along helical path 70, there is no apparent motion of mass 46 from the frame of reference of shaft 34.

Then as swing shaft 34 passes into and thru the optimum angular relationship, the pneumatic cylinder is activated to provide the second stage of acceleration to the mass, using the frame of reference of swing shaft 34. When mass 46 is given its secondary acceleration, it is accelerated relative to swing shaft 34—not relative to its velocity as observed by a bystander. However, a bystander (or other components of the machine) that attempted to catch or make use the energy of the moving masses would find that the masses were moving at the sum of the velocities created by each step of the acceleration.

Thus the primary and secondary accelerations have been directly added together to achieve the desired velocity for each body of mass, thus establishing a level of kinetic energy for the total system or total mass.

A purpose of accelerator for paired masses is to improve the efficiency of systems which transform energy into the acceleration of mass. The embodiment presented here represents methods and means of this invention having the ability to further accelerate two masses in a forward sense with reduction of recoil in the accelerating apparatus. During the simultaneous stroke interval of the respective air cylinders 43 and 43' for launching the paired masses 46 and 46' and adding acceleration thereto, the energy arm 3 with assembled shafts 24, 24', sprockets 25, 25', connecting chain 26, and drive components 21, 19, 20, 10, etc. are all substantially isolated from launch reaction forces and recoil. Referring to FIGS. 1 and 3, the reaction force of cylinder 43 is applied through throw arm 37 to develop rotational torque about shaft 34, which is coupled by the inwardly mounted pivot block 38, rod 40, pivot joint 41, and strut 42 so as to cause a counterclockwise torque in shaft 51 and sprocket 52. Simultaneously the reaction force of cylinder 43' is applied (FIG. 1) through throw arm 37' to develop rotational torque about shaft 34', which is coupled by the outwardly mounted pivot block 38', rod 40', pivot joint 41', and strut 42' so as to cause a clockwise torque in shaft 51' and sprocket 52'. Thus the upper segment of reaction chain 53 (FIG. 1 and 4), being in tension, cross couples the respective reaction forces of the simultaneous mass launch accelerations. The reaction forces being substantially of equal strength are channeled in opposing directions to complement the acceleration of the companion paired mass, thus recoil of the apparatus is absent during the simultaneous stroke intervals of the respective accelerating air cylinders.

A system can be expanded by further addition of the apparatus described above so as to accelerate two or more pairs of masses, all pairs being either simultaneously or sequentially accelerated according to a controlled schedule. It should be noted that variations or modifications of the preferred embodiment described above are within the scope of the present invention. An odd number of masses can be accommodated if they are geometrically arranged so as to be equivalent to paired masses.

Having described the invention, I claim:

1. A method of establishing a level of kinetic energy in a multiple submass system, which comprises the steps of:

a. accelerating, firstly, the mass of a system that comprises a number of discrete submasses that are mechanically arranged in combinations to an initial velocity by an application of a common action force through the supporting mechanical structure of said submasses; and b. accelerating, secondly, after said first acceleration step, each said submass to add additional operating velocity by applications of secondary action forces in each said combination of submasses, each said secondary action force being independently applied to its designated submass, said submasses of each said combination having a mechanical cross coupling linkage that directs its responding reaction force, of said second acceleration step, to the opposing companion submasses thereby aiding their second step of acceleration, said mechanical cross coupling of said reaction forces for conserving energy.

2. A method of establishing a level of kinetic energy in paired submasses of a system, which comprises the steps of:

a. accelerating, firstly, the mass of a system that comprises an even number of discrete submasses that are mechanically arranged in paired combinations to an initial velocity by an application of a common action force through the supporting mechanical structure of said submasses; and b. accelerating, secondly, after said first acceleration step, each said submass to add additional operating velocity by applications of secondary action forces in each said paired combination of submasses, each said secondary action force being independently applied to its designated submass, said submasses of each said paired combination having a mechanical cross coupling linkage that directs its responding reaction force, of said second acceleration step, to the opposing companion submass thereby aiding its second step of acceleration, said mechanical cross coupling of said reaction forces for conserving energy.

3. A method for establishing a level of kinetic energy in paired submasses of a system as defined by claim 2, which further comprises the steps of:

a. guiding, throughout said first accelerating step, the motion of said combinations of paired submasses so that, in response to said common action force, said paired submasses move along phased helical trajectories about a toroidal space;

b. coordinating, during said second accelerating step, the times of said applications of secondary action forces to said paired submasses for simultaneity of said respective reaction forces thereto; and c. transmitting, during said second acceleration step, said respective responding reaction forces simultaneously in opposing directions within said cross coupling linkage between said paired submasses for said energy conservation and for recoil suppression.

4. A method for establishing a level of kinetic energy in paired submasses of a system as defined by claim 3, which still further comprises the steps of:

a. rotating a horizontal energy arm, during said first acceleration step, about a central shaft that is located coincident with the central axis of said toroidal space, in response to said common action force, said energy arm having assembled at opposing ends thereof, operable first and second mass constraining mechanisms comprising means for said guiding step for said motion of paired submasses in said helical trajectories about a toroidal space in further response to energy arm rotation;

b. moving an offset horizontal reaction arm subassembly by interconnecting linkages extending from said first and second operable mass constraining mechanisms, during said first accelerating step, so that said reaction arm rotates about said central shaft in parallel relationship to said energy arm and at the same angular velocity, said reaction arm having assembled thereon means for completing said step of transmitting said reaction forces for cross coupling between said paired submasses; and c. thrusting, after said first acceleration step, said paired submasses in unison for activating said second acceleration step whereby said paired submasses achieve said desired velocity and said level of kinetic energy, in response to said thrusting plus said mutual cross coupling of said respective reaction forces to said companion submasses through said cross coupling linkage comprising said reaction arm subassembly in combination with said first and second operable mass constraining mechanisms.

5. An apparatus for establishing a level of kinetic energy in paired submasses of a system, which comprises:

a. a means for accelerating, firstly, the mass of a system that comprises an even number of discrete submasses that are arranged in paired combinations by a supporting mechanical structure to an initial velocity by an application of a common action force; and b. a means for accelerating, secondly, after said first acceleration, each said submass to add additional operating velocity by applications of secondary action forces in each said paired combination of submasses, each secondary action force being independently applied to its designated submass, said submasses of each said paired combination having a mechanical cross coupling linkage that directs its responding reaction force, of said second acceleration, to the opposing companion submass thereby aiding its second acceleration, said mechanical cross coupling of said reaction forces for conserving energy.

6. An apparatus for establishing a level of kinetic energy in paired submasses of a system as defined by claim 5, which further comprises:

a. a means for guiding, throughout said first acceleration, the motion of said combinations of paired submasses so that, in response to said common action force, said paired submasses move along phased helical trajectories about a toroidal space;

b. a means for coordinating, during said second acceleration, the times of said applications of secondary action forces to said paired submasses for simultaneity of said respective reaction forces thereto; and c. a means for transmitting, during said second acceleration, said respective responding reaction forces simultaneously in opposing directions through said cross coupling linkage between said paired submasses for said energy conservation and for recoil suppression.

7. An apparatus for establishing a level of kinetic energy in paired submasses of a system as defined by claim 6, which still further comprises:

a. a means for rotating a horizontal energy arm, during said first acceleration, about a central shaft that is located coincident with the central axis of said toroidal space, said energy arm having assembled at opposing ends thereof, operable first and second mass constraining mechanisms, responsive to energy arm rotation and comprising means for guiding said motion of paired submasses in said helical trajectories in response to said common action force;

b. a means for moving an offset horizontal reaction arm subassembly by interconnecting linkages extending from said first and second operable mass constraining mechanisms, during said first acceleration, so that said reaction arm rotates about said central shaft in parallel relationship to said energy arm and at the same angular velocity, said reaction arm having assembled thereon means for completing said transmission of said reaction forces for cross coupling between said paired submasses; and c. a means for thrusting, after said first acceleration, said paired submasses in unison for activation said second acceleration whereby said paired submasses achieve said desired velocity and said level of kinetic energy, in response to said thrusting plus said mutual cross coupling of said respective reaction forces to said companion submasses through said cross coupling linkage comprising said reaction arm subassembly in combination with said first and second operable mass constraining mechanisms.

8. An apparatus for establishing a level of kinetic energy in paired submass combinations of a system, comprising:

a. a distributed mass for acceleration to a desired velocity, said distributed mass comprising an even number of similar submasses that are arranged in said paired submass combinations;

b. a base structure for supporting said apparatus;

c. a central cylindrical shaft extending from said base structure;

d. a first bevel gear firmly attached at a midpoint to said central shaft;

e. a mid-shaft stabilizer, affixed beneath said bevel gear to said central shaft, having means for securing said apparatus to a nearby vertical wall;

f. a first support having means for rotation about a lower portion of said central shaft beneath and adjacent to said mid-shaft stabilizer;

g. an energy transmission mechanism, comprising:

an energy arm, affixed at its mid-point to said first support;

a drive shaft with means for mounting at right angles to said energy arm at said mid-point, said drive shaft having fixed to its inner end a second bevel gear for meshing with said first bevel gear, said drive shaft having fixed to its outer end a driving sprocket;

first and second driven shafts, each assembled, parallel to said drive shaft, at opposite ends of said energy arm, said drive shafts having assembled on the outer end thereof first and second driven sprockets respectively;

a first endless roller chain for the intermeshing of said driving sprocket with said first and second driven sprockets for simultaneous rotation thereof in response to said rotation of said first support having said energy arm affixed thereto;

first and second mass constraining mechanisms affixed to said respective first and second driven shafts for rotations of said submasses in phased helical trajectories about a toroidal space centered about said central shaft, responsive to said rotation of said first support having said energy arm affixed thereto, each said mass constraining mechanism comprising:

a plate, arranged parallel to said driven sprocket, for attachment to the inner end of said driven shaft;

first and second angle adjusting bearings spaced apart at the periphery of said plate along a line intersecting and orthogonal to the axis of said driven shaft, the inner race of said adjusting bearings, respectively, for fixed attachment to said plate;

first and second support shafts for fixed attachment to the outer races of said adjusting bearings at the respective ends of a diameter thereof, said support shafts extending radially outward equidistant from the axis of rotation of said driven shaft;

first and second rod-end bearings for termination, of the outer ends of said first and second support shafts, respectively, for coincident axes of said rod-end bearings;

a swing shaft for insertion through said first and second rod-end bearings, the angle of said swing shaft being variable in response to tuning adjustment of said first and second angle adjusting bearings:

a throw arm having one end thereof intersecting said swing shaft at a point lying in a plane that is parallel to the axis of said energy arm and normal to the axis of said driven shaft, said throw arm extending radially inward through loosely fitting inner races of said first and second angle adjusting bearings, ending at a distance opposite said swing shaft relative to said driven shaft; and a pneumatic cylinder attached to the end of said throw arm, opposite said swing shaft, having a linear operating stroke and means for releaseably holding said submass, said pneumatic cylinder for applying thrust to accelerate said submass in a direction selectable by positioning said angle adjusting bearings;

h. a reaction transmission mechanism for conserving energy in the acceleration of said paired submasses and for recoil suppression of said apparatus, comprising:

a second support having means for free rotation about an upper portion, above said first bevel gear, of said central shaft, in response to rotation of said first support and said energy transmission mechanism;

a reaction arm affixed at its mid-point to said second support;

first and second reaction shafts for disposal at opposing ends of said reaction arm in substantial coaxial alignment with said first and second driven shafts, respectively, of said energy transmission mechanism;

first and second reaction sprockets for assembly on the outer ends of said first and second reaction shafts respectively;

a second endless roller sprocket chain for coupling said first and second reaction sprockets;

a first reaction coupling mechanism for said reaction transmission mechanism for attachment to said first reaction shaft, comprising:

a reaction strut, a first end thereof fixed to the inner end of said reaction shaft, and the second end thereof having a pivot joint;

a coupling rod having a first end thereof attached and operative upon said reaction strut pivot joint; and a pivot block, assembled upon said first throw arm beneath and adjacent to said swing shaft, having means for pivotable attachment of a second end of said coupling rod;

a second reaction coupling mechanism for said reaction transmission mechanism for attachment to said second reaction shaft, comprising;

a reaction strut, a first end thereof fixed to the inner end of said reaction shaft, and the second end thereof having a pivot joint;

a coupling rod having a first end thereof attached and operative upon said reaction strut pivot joint; and a pivot block, assembled upon said second throw arm above and adjacent to said swing shaft, having means for pivotable attachment of a second end of said coupling rod;

i. means for applying energy for effecting a first stage of acceleration of said paired submasses into said helical trajectories about a toroidal space;

j. means for activating, in unison, said pneumatic cylinders of said first and second mass constraining mechanisms for effecting a second stage of acceleration of said paired submasses; and k. means for stabilizing the top of said central shaft.

9. An apparatus for recoilless launching of paired bodies of a system, comprising:

a. an even number of similar bodies that are arranged in paired combinations;

b. a base structure for supporting said apparatus;

c. a central cylindrical shaft extending from said base structure;

d. a first bevel gear firmly attached at a midpoint to said central shaft;

e. a mid-shaft stabilizer, affixed beneath said bevel gear to said central shaft, having means for securing said apparatus to a nearby stable body;

f. a first support having means for rotation about a lower portion of said central shaft beneath and adjacent to said mid-shaft stabilizer;

g. an energy transmission mechanism, comprising:

an energy arm, affixed at its mid-point to said first support;

a drive shaft with means for mounting at right angles to said energy arm at said mid-point, said drive shaft having fixed to its inner end a second bevel gear for meshing with said first bevel gear, said drive shaft having fixed to its outer end a driving sprocket;

first and second driven shafts, each assembled, parallel to said drive shaft, at opposite ends of said energy arm, said drive shafts having assembled on the outer end thereof first and second driven sprockets respectively;

a first endless roller chain for the intermeshing of said driving sprocket with said first and second driven sprockets for simultaneous rotation thereof in response to said rotation of said first support, having said energy arm affixed thereto;

first and second body constraining mechanisms affixed to said respective first and second driven shafts for rotations of said body pairs in phased helical trajectories about a toroidal space centered about said central shaft, responsive to said rotation of said first support having said energy arm affixed thereto, each said body constraining mechanism comprising;

a plate, arranged parallel to said driven sprocket, for attachment to the inner end of said driven shaft;

first and second angle adjusting bearings spaced apart at the periphery of said plate along a line intersecting and orthogonal to the axis of said driven shaft, the inner race of said adjusting bearings, respectively, for fixed attachment to said plate;

first and second support shafts for fixed attachment to the outer races of said adjusting bearings at the respective ends of a diameter thereof, said support shafts extending radially outward equidistant from the axis of rotation of said driven shaft;

first and second rod-end bearings for termination, of the outer ends of said first and second support shafts, respectively, for coincident axes of said rod-end bearings;

a swing shaft for insertion through said first and second rod-end bearings, the angle of said swing shaft being variable in response to tuning adjustment of said first and second angle adjusting bearings;

a throw arm having one end thereof intersecting said swing shaft at a point lying in a plane that is parallel to the axis of said energy arm and normal to the axis of said driven shaft, said throw arm extending radially inward through loosely fitting inner races of said first and second angle adjusting bearings, ending at a distance opposite said swing shaft relative to said driven shaft; and a pneumatic cylinder attached to the end of said throw arm, opposite said swing shaft, having a linear operating stroke and means for releaseably holding said body, said pneumatic cylinder for applying thrust to accelerate said body in a direction selectable by positioning said angle adjusting bearings;

h. a reaction transmission mechanism for conserving energy in the acceleration of said paired bodies and for recoil suppression of said apparatus, comprising:

a second support having means for free rotation about an upper portion, above said first bevel gear, of said central shaft, in response to rotation of said first support and said energy transmission mechanism;

a reaction arm affixed at its mid-point to said second support;

first and second reaction shafts for disposal at opposing ends of said reaction arm in substantial coaxial alignment with said first and second driven shafts, respectively, of said energy transmission mechanism;

first and second reaction sprockets for assembly on the outer ends of said first and second reaction shafts respectively;

a second endless roller sprocket chain for coupling said first and second reaction sprockets;

a first reaction coupling mechanism for said reaction transmission mechanism for attachment to said first reaction shaft, comprising:

a reaction strut, a first end thereof fixed to the inner end of said reaction shaft, and the second end thereof having a pivot joint;

a coupling rod having a first end thereof attached and operative upon said reaction strut pivot joint; and a picot block, assembled upon said first throw arm beneath and adjacent to said swing shaft, having means for pivotable attachment of a second end of said coupling rod;

a second reaction coupling mechanism for said reaction transmission mechanism for attachment to said second reaction shaft, comprising:

a reaction strut, a first end thereof fixed to the inner end of said reaction shaft, and the second end thereof having a pivot joint;

a coupling rod having a first end thereof attached and operative upon said reaction strut pivot joint; and a pivot block, assembled upon said second throw arm above and adjacent to said swing shaft, having means for pivotable attachment of a second end of said coupling rod;

i. means for applying energy for effecting a first stage of acceleration of said paired bodies into said phased helical trajectories encompassing at least a portion of about a toroidal space;

j. means for activating, in unison, said pneumatic cylinders of said first and second body constraining mechanisms for effecting a second stage of acceleration of said paired bodies; and k. means for stabilizing the top of said central shaft.

* * * * *